United States Patent [19]

Anderson

[11] 4,021,083

[45] May 3, 1977

[54] SNAP-LOCK END RING

[75] Inventor: Mark O. Anderson, Duncan, Okla.

[73] Assignee: Halliburton Company, Duncan, Okla.

[22] Filed: Mar. 18, 1976

[21] Appl. No.: 668,096

[52] U.S. Cl. ..... 308/4 A
[51] Int. Cl.[2] ..... F16C 17/00
[58] Field of Search ..... 308/4 R, 4 A; 166/241

[56] References Cited

UNITED STATES PATENTS

| | | | |
|---|---|---|---|
| 2,718,266 | 9/1955 | Berry et al. | 308/4 A X |
| 3,055,432 | 9/1962 | Park | 308/4 A X |
| 3,227,498 | 1/1966 | Leathers | 308/4 A |

*Primary Examiner*—Joseph F. Peters, Jr.
*Assistant Examiner*—Gene A. Church
*Attorney, Agent, or Firm*—John H. Tregoning; Bruce E. Burdick

[57] ABSTRACT

A centralizer is disclosed having outwardly bowed leaf springs held by one or more circular end bands. The end bands have two or more sections which are radially overlapped and snapped together to hold the centralizer about a cylindrical object. The end bands can also include a lock to help prevent separation of the end band sections.

Also disclosed is a snap-together method of assembling a centralizer including positioning a first portion of the end band partially around a cylinder, positioning a second portion of the end band partially around the cylinder so as to overlap the first portion, interlocking the portions, pressing to leave the centralizer in position. A projection of one of the portions can be pressed against the other portion to keep the portions interlocked.

Further disclosed is a circular band for attachment to a cylindrical object. The circular band has two arcuate portions, one with a radial projection and the other with a hole for receiving and interlocking with the projection. The band further has a lock tab for maintaining the portions interlocked. The band can have dogs and thus serve as a limit device or stop collar or the band could have openings for ends of the centralizer springs, or both.

28 Claims, 9 Drawing Figures

SNAP-LOCK END RING

Figure 1:
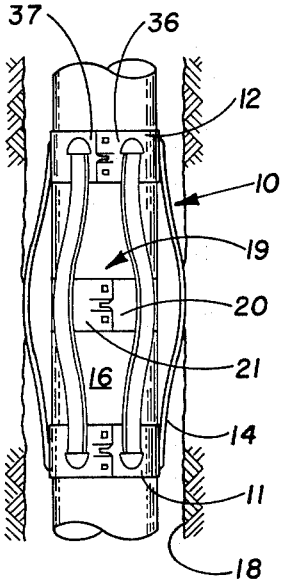

This invention relates to circular bands for attachment to cylindrical objects.

Centralizers find primary utility in the oil well industry for centering casing, tubing and oil well tools within a wellbore. Centralizers customarily comprise two spaced end bands adapted to surround the oil well casing or tubing. Since oil wells are by nature oily and dirty, the attachment of centralizers has been somewhat awkward in that relatively small hinge pins must be fitted within hinges of the end bands to attach the end bands to the casing or tubing. It is desirable to split these end bands into two semi-circular portions in order to attach the centralizer without having to slide it the full length of the casing or tubing, and to allow for attachment on either side of a coupling of the casing or tubing sections, so as to use the coupling to limit longitudinal movement of the centralizer relative to the casing or tubing. Typical of such centralizers are the HALLIBURTON Centralizers shown on pages 2427—2428 of Halliburton Sales and Service Catalog No. 37 (January 1974). While such centralizers are quite satisfactory for many oilfield applications, there is a continual need to facilitate the installation of centralizers on casing and tubing.

Additionally, there is a continual need for easily attachable stop devices. One particularly useful stop device is that shown on page 2425 of Halliburton Sales and Service Catalog No. 37 (January 1974) and known as the EZ LOK limit clamp. However, these clamps have a hinge connection which requires assembly at some time prior to actual placement on the well conduit. Thus, a limit device which eliminated the hinge yet still worked as satisfactorily as the hinged limit device, would be quite useful. One such stop device is that disclosed in U.S. Pat. No. 2,718,266 which provides for circumferentially dove-tailed arcuate portions to interlock about wedge-slips to serve as a limit clamp. However, the stop device of U.S. Pat. No. 2,718,266 is difficult to assemble tightly enough to serve its intended purpose as a stop device for positioning centralizers and has no means for keeping the arcuate portions radially aligned. Another stop device without a hinge is that disclosed in U.S. Pat. No. 2,846,016, which discloses a resilient band with a radial interlock connection and a guide plate.

Another form of band for attachment to a cylindrical object is that of the present invention which provides a circular band for attachment about a cylindrical object, comprising two arcuate portions each having a first end section, a second end section and a central section therebetween, said first end section of one of said portions adapted to radially underly said second end portion of the other of said portions and one of said end sections having a radial opening therethrough to provide a radial interlock surface facing toward said central section from said one of said end section; radial projection means, on the other of said end sections for interlocking with said radial interlock surface to hold said arcuate portions in circular configuration about said cylindrical object; and lock tab means, on said underlying first end section, for radially overlying a portion of said overlying second end section and holding said second end section radially inward against said first end section so as to maintain said radial interlock surface and said radial projection means interlocked.

The apparatus of this invention in another embodiment provide a centralizer for attachment about a cylindrical object, comprising a plurality of leaf springs having an end portion and a bowed portion; and circular end band means for attachment to said end portions of said leaf springs, for circumferentially spacing said leaf springs and for rapid positioning said spaced leaf springs in outwardly bowed position about a cylindrical object, said end band means including at least two arcuate portions, and snap means for interlocking said arcuate portions upon forced transverse movement of said arcuate portions together into a circular configuration corresponding in shape to but of greater diameter than the exterior surface of said cylindrical object.

The method of this invention provides a method of assembling a centralizer having a plurality of outwardly bowed leaf spring held by an end band around a cylinder, which comprises the steps of positioning a first portion of said end band partially around said cylinder; positioning a second portion of said end band partially around said cylinder so as to radially overlap said first portion; pressing radially inward on said first and second portions to maintain said overlap while interlocking said first and second portions; and ceasing both said pressing and said positioning to leave said centralizer in place on said cylinder.

Figure 2:
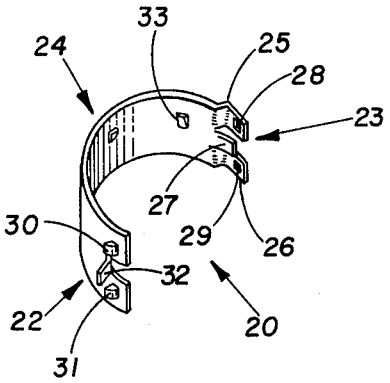
Figure 3:
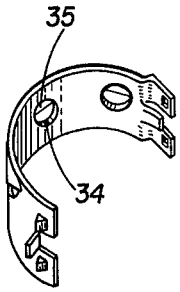
Figure 7:
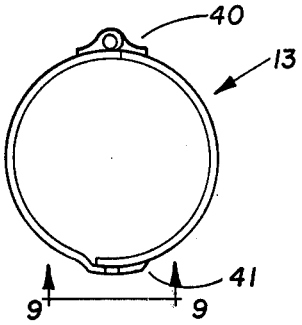
Figure 4:
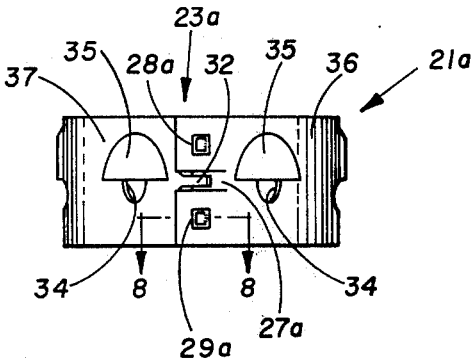
Figure 9:
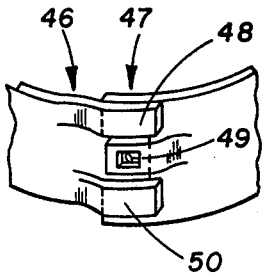
Figure 6:
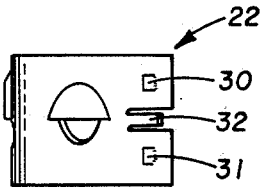
Figure 5:
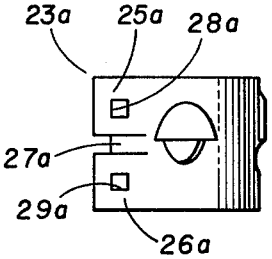
Figure 8:
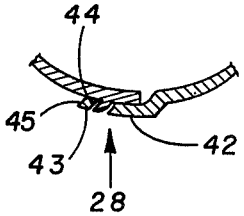

The objects and advantages of this invention will become apparent when the following detailed description of a preferred embodiment of the invention is read with reference to the attached drawings which include:

FIG. 1, a side elevational view of a casing in a wellbore showing a centralizer and stop device embodying the invention;

FIG. 2, an isometric view of an arcuate portion of the stop device of FIG. 1;

FIG. 3, an isometric view of an arcuate portion of a centralizer end band embodying the invention;

FIG. 4, a side view of an assembled end band of a centralizer embodying the invention;

FIG. 5, a side view of a second end section of an arcuate portion of the end band of FIGS. 3 and 4;

FIG. 6, a side view of a first end section of an arcuate portion of the end band of FIGS. 3 and 4;

FIG. 7, a top view of a modified end band having both a hinge and a snap means;

FIG. 8, a cross-section view of the lug and recess of FIG. 4;

FIG. 9, an isometric view of a modified snap means.

Referring to FIG. 1, a centralizer 10 having lower and upper end bands 11 and 12 and outwardly bowed leaf springs 14 is seen attached to a casing or tubing 61 so as to centralize casing 16 within well bore 18. A limiting device 19 is positioned circumferentially around tubing 16 and longitudinally between end bands 11 and 12 so as to limit the longitudinal movement of centralizer 10 relative to casing 16.

Referring to FIG. 2, an arcuate portion 20 of limiting device 19 is seen. Portion 20 includes a first end section 22, a second end section 23 and a central section 24. First end section 22 and second end section 23 are adapted to be connected as shown in FIG. 4 and later described in connection therewith.

Referring to FIGS. 2 and 5, second end section 23 includes first and second raised flanges 25 and 26 and flange 27. First and second raised flanges 25 and 26 each are provided with a rectangular or square hole 28 and 29 respectively, and are connected by flange 27 which is longitudinally interposed therebetween. First end section 22 is provided with radial projections 30 and 31, radial projections 30 and 31 being adapted to interlock with holes 28*a* and 29*a* of a second end section 23*a* of corresponding arcuate portion 21*a* of FIG. 4. First end portion 22 includes a raised tab 32 which is adapted to overly a flange 27*a* of corresponding arcuate portion 21*a* and upon hammering be forced into a tight overlying relation with flange 27*a* so as to keep projections 30 and 31 of portion 20 within holes 28*a* and 29*a* of portion 21. Central section can be provided with dogs 33, such as those in the aforementioned EZ LOK limit clamp, in order to better prevent longitudinal movement, or some other suitable slips or wedges could be used. These dogs 33 could face in one longitudinal direction or both longitudinal directions, depending on the forces expected. Also the holes and radial projections could be reversed so that holes 28 and 29 appeared in first end portion 22 and radial projections 30 and 31 would then be directed inward radially from second end portion 23, but tab 32 would remain on first end portion 22 so as to be able to press against flange 27*a* of corresponding second end portion 23. Tab 32 is clearly optional in that the radial projections and holes could be inclined so as to hold (see FIG. 8) by themselves to prevent separation by a radial overlap due to such inclinations, however tab 32 does provide added protection and is thus preferred.

Looking to FIG. 3, it is seen that dogs 33 could be eliminated and openings 34 and eyelids 35 could be added to create an arcuate portion 36 or 37 of end bands 11 and 12 of centralizer 10. Except for the use of snap means to connect the arcuate portions of the end band thereof, centralizer 10 can be identical to that disclosed in a copending application, Ser. No. 642,264, entitled "Knockdown Centralizer" by Henry J. Clay and assigned to the assignee of this invention, the entire disclosure of which is herein incorporated by reference as if set out at length. Centralizer 10 can also be, except for use of snap means, identical to the HALLIBURTON centralizers shown on pages 2427 and 2428 of Halliburton Sales and Service Catalog No. 37 (January 1974) or other weldable centralizers. End sections 38 and 39 of portion 36 could be substantially identical functionally to end sections 22 and 23 of portion 20 and similarly for portion 37 as respects portion 21. Therefore, detailed explanation of end portions 38 and 39 would be unduly repetitive and is omitted.

The operation of centralizer 10 and limit device 19 is felt to be self-evident from the structure thereof, but will be described briefly. Limit device 19 would be located at a desired point on casing or tubing 16 by aligning arcuate portions 20 and 21 and pressing radially inward thereon to "snap" radial projections 30 and 31 into holes 28*a* and 29*a* respectively, and radial projections 30*a* and 31*a*, not shown, into holes 28 and 29. Tabs 32 and 32*a*, not shown, could then be hammered onto flanges 27*a* and 27, respectively, to maintain the interlock of the radial projections and holes. This assembly of portions 20 and 21 would force dogs 33 into engagement with casing 16 to prevent undesired longitudinal movement of limit device 19 relative thereto.

Centralizer 10 would then be assembled and installed about casing 16 as described below with end bands 11 and 12 on opposite longitudinal sides of limit device 19. The assembly of centralizer 10 comprises two separate stages, assembly of the springs 14 to the arcuate portions 36 and 37 of the end bands 11 and 12, and assembly of the arcuate portions 36 and 37 about casing 16. For assembly of the springs 14 to the arcuate portions reference is made to the aforementioned "Knockdown Centralizer" application, Ser. No. 642,264, of Henry J. Clay, where such assembly is described in detail and to U.S. Pat. Nos. 3,055,432 and 2,738,019 which also describe such assembly methods. Once springs 14 are attached to arcuate portions 36 and 37, arcuate portions 36 and 37 are positioned on either side of limit device 19 or on either side of a casing coupling (not shown) and the end sections thereof are joined as described with respect to limit Clamp 19.

Thus, it is seen that the present invention provides an easily assembled centralizer or limit device or combined limit device and centralizer.

FIGS. 7, 8 and 9 show some examples of modifications. FIG. 7 shows use of hinge 40 and snap means 41 on opposite sides of the end band 13. FIG. 8 shows one way which the radial interlock surfaces can be inclined from outer end 43 to inner end 44 thereof to produce an inward restraint. FIG. 9 shows that the snap means 41 can be a modified version of the snap means of FIGS. 1–6 by providing longitudinally outward projecting overlap means 48 and 50 on ends 46 and 47 of the end band portions and using only one recess and lug connection 49.

From the variations herein disclosed, it will be readily apparent to those skilled in the art to make other modifications within the scope of the invention to suit their particular manufacturing processes or aesthetic desires. The invention is intended to cover all such modifications.

I claim:

1. A centralizer for attachment about a cylindrical object, comprising:

a. a plurality of leaf springs having an end portion and a bowed portion; and b. circular end band means for attachment to said end portions of said leaf springs, for circumferentially spacing said leaf springs and for slidably positioning said spaced leaf springs in outwardly bowed position about a cylindrical object, said end band means including:

i. at least two arcuate portions;

ii. snap means for radially overlapping and rigidly and radially interlocking said arcuate portions upon forced transverse movement of said arcuate portions together into a circular configuration corresponding in shape to, but of greater diameter than, the exterior surface of said cylindrical object; and iii. radial lock means for maintaining said snap means rigidly interlocked when a greater radial force is applied to one of said arcuate portions than to the other of said arcuate portions.

2. The centralizer of Claim 1, wherein:

one of the arcuate portions has a second end section including first and second raised flange means for overlying a first end section of another arcuate portion and preventing outward radial movement of the first end section relative to the second end section and has a third flange interposed between the first and second raised flange means; and another of the arcuate portions has a first end section means for underlying the raised flange means of the second end section and a tab means for overlying and inwardly restraining the third flange.

3. The centralizer of claim 1, wherein:

the number of snap means is equal to the number of arcuate portions and the number of lock means is equal to one-half the number of arcuate portions.

4. The centralizer of claim 1, wherein:

the number of snap means is equal to twice the number of arcuate portions and the number of lock means is equal to the number of arcuate portions.

5. The centralizer of claim 1, wherein:

said leaf springs each have two of said end portions; and said circular end band means includes two circular bands, each of said two bands adapted to hold one of said end portions of each of said leaf springs.

6. The centralizer of claim 1, wherein said lock means includes:

slot means, adjacent a first end of one of said arcuate portions, for receiving a tab means; and bendable tab means, adjacent a second end of another of said arcuate portions, for interlocking with said slot so as to radially press overlapping end sections of said arcuate portions together.

7. The centralizer of claim 6, having at least one of said lock means and at least two of said snap means.

8. The apparatus of claim 1, further comprising:

hinge means, on the circumferential end of said arcuate portions opposite said snap means, for rotatably connecting said arcuate portions.

9. The centralizer of claim 1, wherein:

each of said end portions of said leaf springs include an arcuate surface; and said end band means includes portions defining an arcuate opening adapted to receive and interlocking with said arcuate surfaces of said leaf springs.

10. The centralizer of claim 1, wherein:

each of said end portions of said leaf springs include a disc-shaped inward projecting radial lug; and said end band means includes portions defining circular openings therein adapted to receive and interlock with said disc-shaped lugs.

11. The centralizer of claim 1, wherein: said snap means includes:

i. radially projecting lug means on a first end of one of said arcuate portions, for providing a first radial interlock surface;

ii. recess means, in a second end of another of said arcuate portions, for providing a second radial interlock surface adapted to engage said first radial interlock surface to help prevent circumferential separation of said arcuate portions; and said lock means includes iii. circumferential overlap means, extending radially and circumferentially from a first of said arcuate portions, for radially and externally overlapping a second of said arcuate portions to maintain said lug within said recess means.

12. The centralizer of claim 11, wherein:

said recess means defines a rectangular hole through said another of said arcuate portions adjacent said second end thereof.

13. The centralizer of claim 11, wherein:

said recess is a rectangular recess in a longitudinal edge of said another of said arcuate portions adjacent said second end thereof.

14. The centralizer of claim 11, wherein:

said snap means includes two lug means and two recess means in longitudinal alignment respectively on said one of said arcuate portions and on said another of said arcuate portions.

15. The centralizer of claim 14, wherein:

said overlap means extends longitudinally between said two lug means for pressing against the region of said another of said arcuate portions between said two recess means so as to help prevent separation of said first and second interlock surfaces.

16. The centralizer of claim 11, wherein:

said lug means projects radially outward from said one of said arcuate portions.

17. The centralizer of claim 11, wherein:

said lug means projects radially inward from said one of said arcuate portions.

18. The centralizer of claim 11, wherein:

said overlap means extends longitudinally outward from said another of said arcuate portions.

19. The centralizer of claim 11, wherein:

said projection means is located at the longitudinal center of said another of said arcuate portions.

20. The centralizer of claim 11, wherein:

said first radial interlock surface is closer to said first end at the inward radial end of said first radial interlock surface than at the outward radial end thereof, whereby a radial recess is created in said first interlock surface; and said second interlock surface is tapered so as to fit within said radial recess of said first interlock surface and be inwardly restrained by said first interlock surface.

21. A method of assembling a centralizer having a plurality of outwardly bowed leaf spring held by an end band around a cylinder, which comprises the steps of:

a. positioning a first portion of said end band partially around said cylinder;

b. positioning a second portion of said end band partially around said cylinder so as to radially overlap said first portion;

c. pressing radially inward on said first and second portions to maintain said overlap while interlocking said first and second portions; and d. ceasing both said pressing and said positioning to leave said centralizer in place on said cylinder.

22. The method of claim 21, further comprising the step, after step (d), of:

pressing a tab of one of said portions radially against another of said portions to assist in maintaining said portions interlocked.

23. A circular band for attachment about a cylindrical object comprising:

a. two arcuate portions each having a first end section, a second end section and a central section therebetween, said first end section of one of said portions adapted to radially underly said second end portion of the other of said portions and one of said end sections having a radial opening therethrough to provide a radial interlock surface facing toward said central section from said one of said end sections;

b. radial projection means, on the other of said end sections for interlocking with said radial interlock surface to hold said arcuate portions in a rigid circular configuration about said cylindrical object; and c. lock tab means, on said underlying first end section, for radially overlying a portion of said overlying second end section and holding said second end section radially inward against said first end section so as to maintain said radial interlock surface and said radial projection means interlocked.

24. The circular band of claim 23, further comprising:

d. gripping means, on an internal surface of said arcuate portions, for preventing longitudinal movement of said arcuate portions relative to said cylindrical object when said radial projection means and radial interlock surface are interlocked.

25. The band of claim 23, further comprising:

e. slot means, in said portion of said overlying second end portion, for receiving said lock tab means and longitudinally maintaining said lock tab means within said slot means.

26. The circular band of claim 25, further comprising:

d. gripping means, on an internal surface of said arcuate portions, for preventing longitudinal movement of said arcuate portions relative to said cylindrical object when said radial projection means and radial interlock surface are interlocked.

27. The band of claim 23, wherein said lock tab means is made of a malleable metal and wherein said lock tab means is in an initial position overlying but not holding said overlying second end portion, thereby allowing said lock tab means to be hammered into a final position holding said overlying second end portion.

28. The circular band of claim 27, further comprising:

d. gripping means, on an internal surface of said arcuate portions, for preventing longitudinal movement of said arcuate portions relative to said cylindrical object when said radial projection means and radial interlock surface are interlocked.

* * * * *